US007900272B1

(12) United States Patent
Tan et al.

(10) Patent No.: US 7,900,272 B1
(45) Date of Patent: Mar. 8, 2011

(54) STATIC CONTROL GARMENT

(75) Inventors: Huynh P. Tan, San Jose, CA (US); Julius A. Turangan, Livermore, CA (US); Muralidhar R. Dugyala, Milpitas, CA (US)

(73) Assignee: Western Digital Technologies, Inc., Irvine, CA (US)

( * ) Notice: Subject to any disclaimer, the term of this patent is extended or adjusted under 35 U.S.C. 154(b) by 608 days.

(21) Appl. No.: 11/508,766

(22) Filed: Aug. 23, 2006

(51) Int. Cl.
*A41D 13/00* (2006.01)

(52) U.S. Cl. ..... 2/69; 2/93; 2/94; 2/79; 361/223

(58) Field of Classification Search ..... 2/69, 2/93, 94, 79; 361/223
See application file for complete search history.

(56) References Cited

U.S. PATENT DOCUMENTS

| | | | | |
|---|---|---|---|---|
| 2,784,376 | A | 3/1957 | Steele | |
| 3,596,134 | A | 7/1971 | Burke | |
| 4,590,623 | A * | 5/1986 | Kitchman | 361/220 |
| 4,596,053 | A | 6/1986 | Cohen et al. | |
| 4,639,825 | A | 1/1987 | Breidegam | |
| 4,736,157 | A | 4/1988 | Betker et al. | |
| 4,745,519 | A | 5/1988 | Breidegam | |
| 4,800,374 | A | 1/1989 | Jacobson | |
| 5,083,092 | A | 1/1992 | Clark et al. | |
| 5,422,630 | A | 6/1995 | Quinn et al. | |
| 5,426,870 | A | 6/1995 | Purnell et al. | |
| 5,440,444 | A | 8/1995 | Adams | |
| 5,519,384 | A | 5/1996 | Chanudet et al. | |
| 5,548,469 | A | 8/1996 | Adams | |
| 5,576,924 | A | 11/1996 | Hee | |
| 5,666,106 | A | 9/1997 | Nasman | |
| 5,686,897 | A | 11/1997 | Loh | |
| 5,715,536 | A * | 2/1998 | Banks | 2/69 |
| 5,952,931 | A | 9/1999 | Chotichanon et al. | |
| 5,991,145 | A | 11/1999 | Lagrotta et al. | |
| 5,991,922 | A * | 11/1999 | Banks | 2/69 |
| 6,014,773 | A | 1/2000 | Banks | |
| 6,026,512 | A | 2/2000 | Banks | |
| 6,035,260 | A | 3/2000 | Pohribnij et al. | |
| 6,078,875 | A | 6/2000 | Jubin et al. | |
| 6,140,929 | A | 10/2000 | Gannon | |
| 6,272,694 | B1 | 8/2001 | Weaver et al. | |
| 6,510,987 | B1 | 1/2003 | Hengriprasopchoke et al. | |
| 6,577,287 | B2 | 6/2003 | Havel | |
| 6,714,814 | B2 | 3/2004 | Yamada et al. | |
| 6,767,603 | B1 | 7/2004 | Hurst et al. | |
| 6,809,522 | B2 | 10/2004 | Nguyen | |
| 2004/0198117 | A1 | 10/2004 | Caudell | |
| 2005/0278826 | A1 * | 12/2005 | Kato | 2/131 |

(Continued)

OTHER PUBLICATIONS

Office Action dated Nov. 25, 2008, from U.S. Appl. No. 11/637,527, 6 pages.

(Continued)

*Primary Examiner*—Gary L Welch
*Assistant Examiner*—Alissa J Tompkins

(57) ABSTRACT

A static control garment may be worn by a user. The garment includes first and second conductive portions, a first user interface for electrically coupling the first conductive portion to the user, a second user interface for electrically coupling the second conductive portion to the user, and an insulative portion coupled to, and separating the first and second conductive portions. Preferably, the first and second conductive portions comprise substantially the same amount of conductive material.

17 Claims, 6 Drawing Sheets

U.S. PATENT DOCUMENTS

2006/0261818 A1 11/2006 Zank et al.

OTHER PUBLICATIONS

Office Action dated Jan. 26, 2009, from U.S. Appl. No. 11/637,527, 17 pages.
Desco Industries, Inc., "Dual-Wlre Workstation Continuous Monitor Installation, Operation, and Maintenance", Sep. 2006, Desco Technical Bulletin TB-3019, www.desco.com/pdf/tb-3019.pdf, 4 pages
Office Action dated Oct. 19, 2009 from U.S. Appl. No. 11/637,527, 11 pages.
Office Action dated Jul. 21, 2009 from U.S. Appl. No. 11/637,527, 15 pages.
Notice of Allowance dated Sep. 7, 2010 from U.S. Appl. No. 11/637,527, 12 pages.
Notice of Allowance dated Sep. 9, 2010 from U.S. Appl. No. 12/356,204, 9 pages.
Office Action dated Mar. 31, 2010 from U.S. Appl. No. 11/637,527, 19 pages.
Office Action dated Mar. 31, 2010 from U.S. Appl. No. 12/356,204, 31 pages.

* cited by examiner

STATIC CONTROL GARMENT

BACKGROUND

1. Field

This invention relates to static control garments.

2. Description of the Related Art

Static electricity represents a serious threat to electronic components, which may become damaged during the manufacturing process when the personnel handling these components are not effectively grounded. It is desirable to ground not only the bodies of the personnel working with these components, but their clothing as well, as charge can build up in either location.

The "bunny suit" is a popular garment used to ground personnel and their clothing. Typically, the bunny suit is made from a knit or woven fabric comprising an electrically conductive Faraday cage grid. The garment thereby effectively shields the personnel and his or her clothing from delicate electronic components. One or more close fitting connections may also be used to electrically couple the wearer's body to the bunny suit and/or to ground. For example, a wrist strap having an attached grounding cord may be incorporated into the bunny suit in order to couple the wearer's body to ground.

Unfortunately, the conventional bunny suit is not ideal. For example, in order to determine whether or not the bunny suit is effectively grounding its wearer, two connections should couple the wearer to a monitoring circuit. However, because the entire garment is made from electrically conductive material, a number of uncontrolled parallel electrical paths are formed between the wearer's body, street clothing and bunny suit, and the monitoring circuit. These parallel paths can make the monitoring circuit's output unreliable.

Moreover, the grounding of the bunny suit is typically only tested occasionally. The use of conventional monitoring circuits is inconvenient (often requiring the wearer to manually touch a ground, for example, to define a current loop), and they may be located far from where the wearer is working with the electronic components.

The prior art has not disclosed an effective way of monitoring the status of a wearer's connection to ground. The prior art has also not disclosed an effective way to ameliorate the problem of multiple, uncontrolled parallel electrical paths undermining the accuracy of ground monitoring.

DETAILED DESCRIPTION OF EMBODIMENTS OF THE INVENTION

Figure 1A:
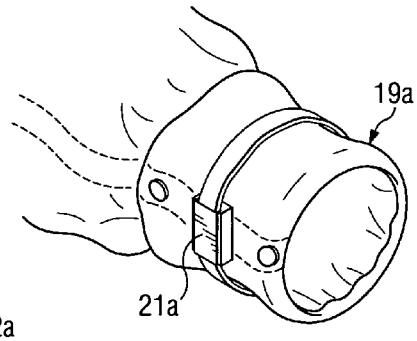
FIG. 1A shows an enlarged view of one cuff of the labcoat of FIG. 1.
Figure 1:
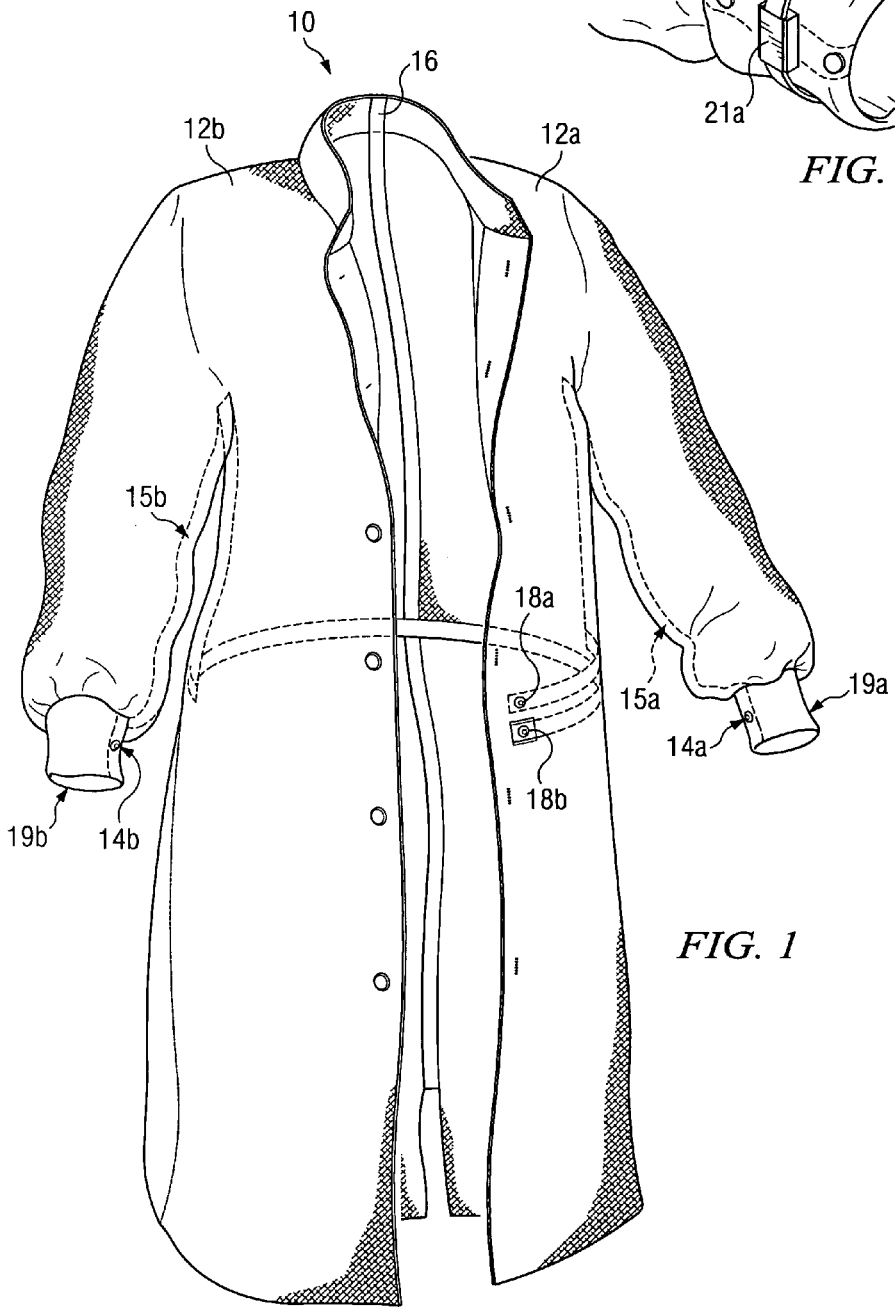
FIG. 1 shows a perspective view of a static control garment, a labcoat, according to one embodiment of the present invention.

Referring to FIG. 1, a static control garment configured to be worn by a user (not shown) is illustrated according to one embodiment of the present invention. As shown in FIG. 1, the garment comprises a labcoat 10, although other configurations (such as that shown in FIG. 3) may also be used. The labcoat 10 comprises first and second conductive portions 12*a*, 12*b*, a first user interface 14*a* for electrically coupling the first conductive portion 12*a* to the user, a second user interface 14*b* for electrically coupling the second conductive portion 12*b* to the user, and an insulative portion 16 coupled to and separating the first and second conductive portions 12*a*, 12*b*. In one embodiment, the first and second conductive portions 12*a*, 12*b* comprise substantially the same amount of conductive material.

As illustrated, the labcoat 10 may generally extend to around the mid-thigh of the user, and may be buttoned up the front using buttons made of an insulative material. However, this particular style of static control garment is shown solely for purposes of illustration, since the shape and style of the garment may be varied.

The first and second conductive portions 12*a*, 12*b* may be made from any relatively conductive fabric. In one embodiment, each of the conductive portions 12*a*, 12*b* comprises a knit or woven fabric including therein an electrically conductive and dissipative Faraday cage grid. For example, polyester carbon-infused nylon may be woven into a conductive grid pattern throughout each of the conductive portions. Thus, the nylon grid forms an electrically conductive carbon mesh that shields electrical components being worked on from the radiation of static electricity from a user's "street" clothing worn under the static control garment. In another embodiment, the fabric may comprise polyester, nylon, cotton or other synthetic or non-synthetic materials, or a blend of these fabrics. Running through these materials, conductive threads of copper, stainless-steel, carbon or silver-loaded filaments, or other metallic or non-metallic conductive elements may also comprise the conductive portions.

In some embodiments, the first and second conductive portions 12*a*, 12*b* may be made from different conductive materials having similar electrical properties, but in other embodiments, the same material is used to manufacture both portions. In one embodiment, the conductive material used to make these conductive portions 12*a*, 12*b* has a resistance of less than $10^9$ ohms per square, but preferably not less than $10^3$ ohms per square.

Figure 3:
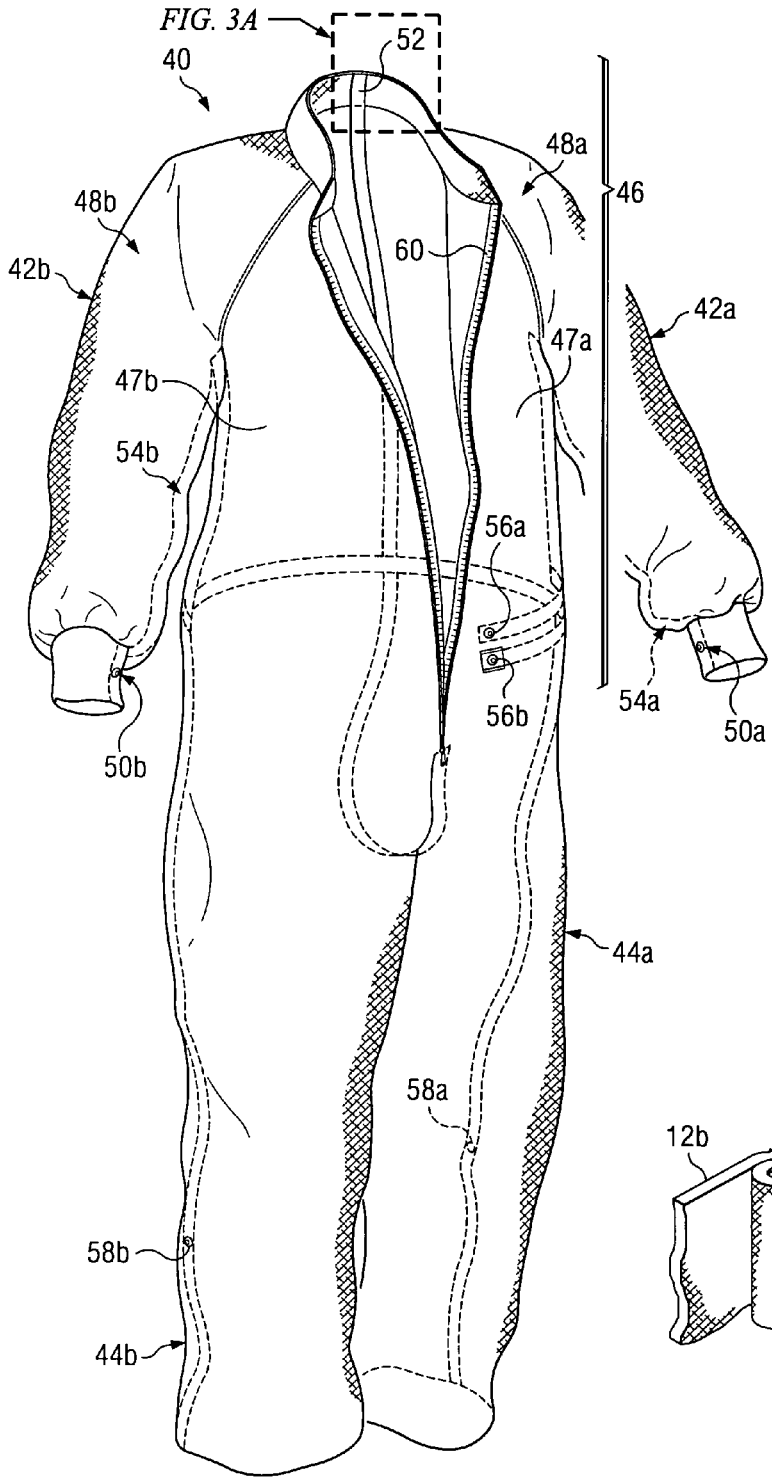
FIG. 3 shows a perspective view of a static control garment, a bunny suit, according to another embodiment of the present invention.

While the first and second conductive portions 12*a*, 12*b* are illustrated as each making up nearly all of one half of the labcoat 10, it should be understood that the first and second conductive portions may, in other embodiments, comprise substantially less material. Thus, a significant percentage of the static control garment may comprise non-conductive material (e.g., the sleeves may not be conductive in one embodiment, or the legs of a bunny suit (as illustrated in FIG. 3) may not be conductive in another embodiment). Preferably, however, the majority of each half of the labcoat does comprise conductive material, in order to effectively shield more of the user's body using the garment as a Faraday cage.

The first user interface 14*a* electrically couples the first conductive portion 12*a* to the user when the garment is worn. It may accomplish this electrical connection in any of a variety of ways. In one embodiment, as illustrated in FIG. 1A (which shows the cuff 19*a* inverted), the first user interface 14*a* comprises a metal plate 21*a* on the inside of a cuff 19*a* of the labcoat 10. The cuff 19*a* may include elastic, stretchable material to compress the cuff 19*a* against a user's skin when worn. Thus, the metal plate 21*a* of the first user interface 14*a* is also pressed against the bare skin of the user's wrist, creating an electrical connection between the user and the first user interface 14*a*. In one embodiment, multiple metal plates 21*a* are provided to form the first user interface 14*a*, such that redundant electrical connections are made between the user and the static control garment.

In another embodiment, the elastic material comprising the cuff 19*a* may itself be electrically conductive and may thereby comprise the first user interface 14*a*. In still another embodiment, the user may wear a separate wristband, and a first user interface 14*a* of the labcoat 10 may couple to this separate wristband (via snaps, wires, or other means) and be thereby electrically coupled indirectly to the user. Preferably, the user interface 14*a* couples to the user at the user's wrist because this is a portion of the user's body often left bare by street clothing. However, in other embodiments, the user interface 14*a* may couple to any body part to facilitate a relative secure electrical connection.

The first user interface 14*a* may be directly coupled to the first conductive portion 12*a*, and may be understood to form a part of the first conductive portion 12*a*. For example, the cuff 19*a* may comprise part of the first conductive portion 12*a*, and the metal plate 21*a* comprising the first user interface 14*a* may be in direct electrical contact with the cuff 19*a*. In another embodiment (shown in FIG. 1), the first conductive portion 12*a* includes therein a ribbon of conductive material 15*a* that is not electrically isolated from the rest of the conductive portion 12*a*. This ribbon of conductive material 15*a* may be sewn into a seam of the first conductive portion 12*a*, as illustrated. The ribbon 15*a* may be formed from any of a variety of conductive materials, and in one embodiment comprises carbon-infused nylon. In other embodiments, carbon or copper-based conductive threads, ribbons or metal/metal-infused tapes may be used to form the ribbon 15*a*. The first user interface 14*a* may electrically contact the ribbon 15*a*, and may thereby electrically couple the user to the first conductive portion 12*a* through the ribbon.

In one embodiment, the second user interface 14*b* is configured identically to the first user interface 14*a*, just on the other side of the garment. However, in other embodiments, of course, the two interfaces may be configured differently.

Figure 3A:
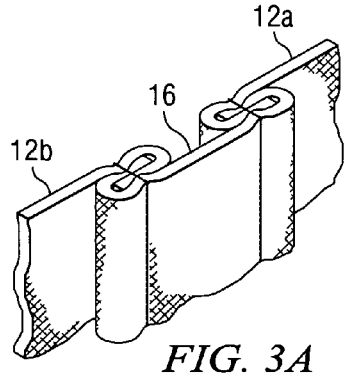
FIG. 3A shows an enlarged cut-away of a seam of the bunny suit of FIG. 3.

The insulative portion 16 is coupled to both the first and second conductive portions 12*a*, 12*b*, and generally separates them. The insulative portion 16 may be coupled to the conductive portions 12*a*, 12*b* by a variety of methods used in the garment industry. For example, as illustrated in FIG. 3A, the insulative portion 16 may be folded together with each conductive portion in a double felt configuration, and then joined by any of a number of stitches. Lock, common-tailor or other stitches, staples, glue, or other affixing means may also be used to couple the insulative portion 16 to the first and second conductive portions 12*a*, 12*b*.

In one embodiment, the insulative portion 16 runs generally along a midline of the user's torso. However, in other embodiments, the insulative portion may be offset to one side of the user's torso or another according to the needs (aesthetic or technical) of a particular implementation. Indeed, while the insulative portion 16 is shown along a vertical midline, the insulative portion 16 may also run generally along a horizontal midline. In one embodiment, the insulative portion 16 may comprise a polyester material without conductive elements therethrough, so that the insulative portion and conductive portions have substantially similar wash-and-dry properties. However, other fabrics may also be used, including polyester, nylon, cotton or other synthetic or non-synthetic materials, or a blend of these fabrics.

The insulative portion 16 is located between the first and second conductive portions 12*a*, 12*b* as illustrated in FIG. 1. However, it need not completely isolate these conductive portions from each other. For example, in one embodiment, as illustrated, the first and second conductive portions 12*a*, 12*b* may come into momentary contact with each other if one conductive portion of the labcoat 10 rubs against the other conductive portion. As another example, when the labcoat 10 is worn, it may be buttoned up the front, and the first and second conductive portions 12*a*, 12*b* may be placed in relatively constant contact with each other. However, the first and second conductive portions 12*a*, 12*b* are preferably not sewn together or otherwise relatively permanently attached except through insulative material. In some embodiments, the labcoat may use insulated buttons, as shown in FIG. 1, or a zipper may be used that includes an insulative fabric to provide further isolation between the two sides of the garment (see FIG. 3). Preferably, even if the first and second conductive portions 12*a*, 12*b* come into contact with each other, there is a much higher resistance to this contact than if they were a unitary piece.

In one embodiment, as set forth above, the first and second conductive portions 12*a*, 12*b* comprise substantially the same amount of conductive material. For example, the two portions may comprise the same amount of conductive material within manufacturing tolerances for manufacturing the garment. In another embodiment, the first and second conductive portions 12*a*, 12*b* comprise substantially the same amount of conductive material, such that the capacitance between each conductive portion of the garment and ground is approximately the same (within 10%).

In another embodiment, the amounts of material in the first and second conductive portions 12*a*, 12*b* do not differ by more than 30%. In another embodiment, the amounts of material in the first and second conductive portions 12*a*, 12*b* do not differ by more than 20%. In yet another embodiment, the amounts of material in the first and second conductive portions 12*a*, 12*b* do not differ by more than 10%. In yet another embodiment, the amounts of material in the first and second conductive portions 12*a*, 12*b* do not differ by more than 5%. It may be understood that different monitoring devices that may be used to ensure that the user and garment are effectively grounded may be more or less sensitive to differing amounts of material for the first and second conductive portions 12*a*, 12*b*. Thus, in some environments, the amounts of material in the first and second conductive portions 12*a*, 12*b* should not differ by more than 5%, while in other environments, this requirement may be relaxed.

Figure 2:
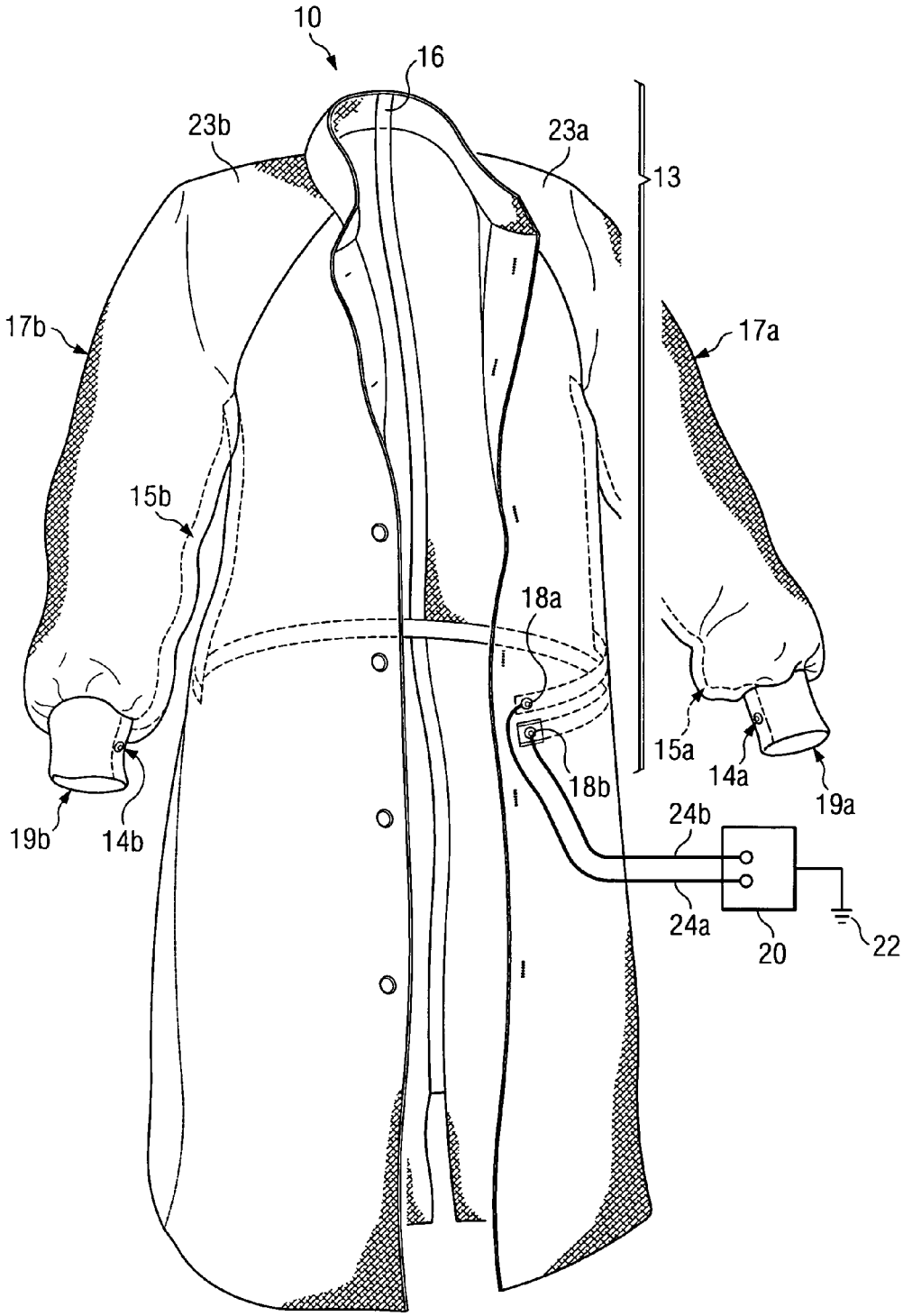
FIG. 2 shows a perspective view of the labcoat of FIG. 1 coupled to a monitoring device.

Referring to FIG. 2, the labcoat 10 may be further understood to include a torso portion 13, and first and second arm portions 17*a*, 17*b*. In one embodiment, the torso portion 13 of the labcoat 10 comprises first and second conductive portions 23*a*, 23*b*, which are separated by the insulative portion 16. As illustrated, the first and second conductive portions 23*a*, 23*b* that comprise the torso portion 13 form a part of the larger first and second conductive portions 12*a*, 12*b* (illustrated in FIG. 1), which are discussed at length above. Thus, in one embodiment, the first and second conductive portions 12*a*, 12*b* comprise material from the respective arm portions 17*a*, 17*b*, as well as the first and second conductive portions 23*a*, 23*b* of the torso portion 13.

Of course, different configurations are possible. For example, the first and second arm portions 17*a*, 17*b* need not be made from conductive material. In one embodiment, the first and second arm portions 17*a*, 17*b* may comprise conductive fabric, but may each be electrically uncoupled from the torso portion 13.

Referring further to FIG. 2, the labcoat 10 may further comprise first and second electrical interfaces 18*a*, 18*b* for electrically coupling to a monitoring device 20. In one embodiment, as shown, leads 24*a*, 24*b* run from both electrical interfaces 18*a*, 18*b* to the monitoring device 20. In other embodiments, only one of the electrical interfaces need be coupled to a monitoring device. These electrical interfaces 18*a*, 18*b* may be configured in a variety of ways. For example, the electrical interfaces 18*a*, 18*b* may comprise metallic snaps to which the monitoring device 20 can attach by leads 24*a*, 24*b* having mating connectors. In another embodiment, the electrical interfaces 18*a*, 18*b* comprise female receptacles for banana plugs coupled to the monitoring device 20. Any other suitable electrical interfaces may be used to couple the labcoat 10 and monitoring device 20.

A number of monitoring devices may be used with the labcoat 10 illustrated in FIGS. 1 and 2. In one embodiment, a monitoring device 20 may periodically send a current through a first lead, and receive a current through a second lead. The monitoring device 20 may thereby derive a resistance measurement of the circuit formed by the garment and user. If a large resistance is detected, an alarm may be triggered indicating that the user of the garment is not properly grounded. In another embodiment, a monitoring device, such as a Dual Wire Continuous Monitor, Part No. 19665, produced by Desco Industries, Inc., may be used. Other monitoring devices differently configured may also be used.

The monitoring device 20 may be coupled to the labcoat 10 while the user moves around performing job functions, or the monitoring device 20 may only be coupled to the labcoat 10 at particular ESD testing stations (not shown), so that grounding of the labcoat 10 is tested more intermittently.

As illustrated in FIG. 2, the first user interface 14*a* may be electrically coupled to the first electrical interface 18*a*, and the second user interface 14*b* may be electrically coupled to the second electrical interface 18*b*. Any electrical connection may be used. As illustrated, the first user interface 14*a* and first electrical interface 18*a* are coupled by the ribbon of conductive material 15*a*. Similarly, the second user interface 14*b* and second electrical interface 18*b* are coupled by a ribbon of conductive material 15*b* extending through the labcoat 10. In one embodiment, the two ribbons 15*a*, 15*b* are made from the same material.

As is also illustrated in FIG. 2, the second electrical interface 18*b* may be surrounded by the first conductive portion 12*a*. In fact, as shown in the Figure, the second electrical interface 18*b* is embedded within the material that comprises the first conductive portion 12*a*. However, in one embodiment, the second electrical interface 18*b* remains insulated from the first conductive portion 12*a*. Thus, as shown, the ribbon 15*b* may pass through the second conductive portion 12*b* through a non-insulated seam, and, as it passes through the insulative portion 16 and into the first conductive portion 12*a*, a strip of insulative material preferably surrounds and insulates the ribbon 15*b* from the first conductive portion 12*a* surrounding it. Other means of electrically isolating the ribbon 15*b* may be used in other embodiments. Similarly, the second electrical interface 18*b*, although surrounded by the first conductive portion 12*a*, is preferably electrically isolated from the first conductive portion 12*a* by insulative materials.

Preferably, the first and second electrical interfaces 18*a*, 18*b* are located adjacent one another and are surrounded by the first conductive portion 12*a*. Such a configuration facilitates creating an electrical connection between the labcoat 10 and monitoring device 20, as the user can quickly and easily attach and detach the leads from his waist.

Referring to FIG. 3, the static control garment may alternatively comprise a bunny suit 40. Such a bunny suit 40 comprises arms 42*a*, 42*b*, legs 44*a*, 44*b*, and a torso portion 46. In a preferred embodiment, the torso portion 46 further comprises first and second conductive torso portions 47*a*, 47*b* separated by an insulative portion 52.

The bunny suit 40 may be further described as comprising first and second conductive portions 48*a*, 48*b* (which include the first and second conductive torso portions 47*a*, 47*b* of the torso portion 46 respectively), a first user interface 50*a* for electrically coupling the first conductive portion 48*a* to the user, a second user interface 50*b* for electrically coupling the second conductive portion 48*b* to the user, and an insulative portion 52 coupled to and separating the first and second conductive portions 48*a*, 48*b*. In one embodiment, the first and second conductive portions 48*a*, 48*b* comprise substantially the same amount of conductive material.

The materials and structures comprising the bunny suit 40 may be generally the same as those discussed above used to construct different embodiments of the labcoat 10. However, in a preferred embodiment, the legs 44*a*, 44*b* of the bunny suit 40 form part of the first and second conductive portions 48*a*, 48*b*, respectively. Secondly, as illustrated, a zipper 60 may be used to close the bunny suit 40 when worn, in order to provide further insulation between the two conductive portions 48*a*, 48*b* of the bunny suit 40. Thirdly, the ribbons of conductive material 54*a*, 54*b*, coupling the user interfaces 50*a*, 50*b* to the electrical interfaces 56*a*, 56*b*, respectively, may extend down the legs 44*a*, 44*b* of the bunny suit 40 in one embodiment.

Near the bottom of the bunny suit 40, these ribbons of conductive material 54*a*, 54*b* may be electrically coupled to a pair of bootie interfaces 58*a*, 58*b*. The bootie interfaces 58*a*, 58*b* may be configured in a variety of ways in order to support an electrical connection between the bunny suit 40 and a pair of booties 62*a*, 62*b* (such as those shown in FIGS. 4 and 5). For example, in one embodiment, the bootie interfaces 58*a*, 58*b* comprise metallic snaps (which may be identical to the electrical interfaces 56*a*, 56*b*) to which the booties 62*a*, 62*b* can attach by mating connectors.

Figure 4:
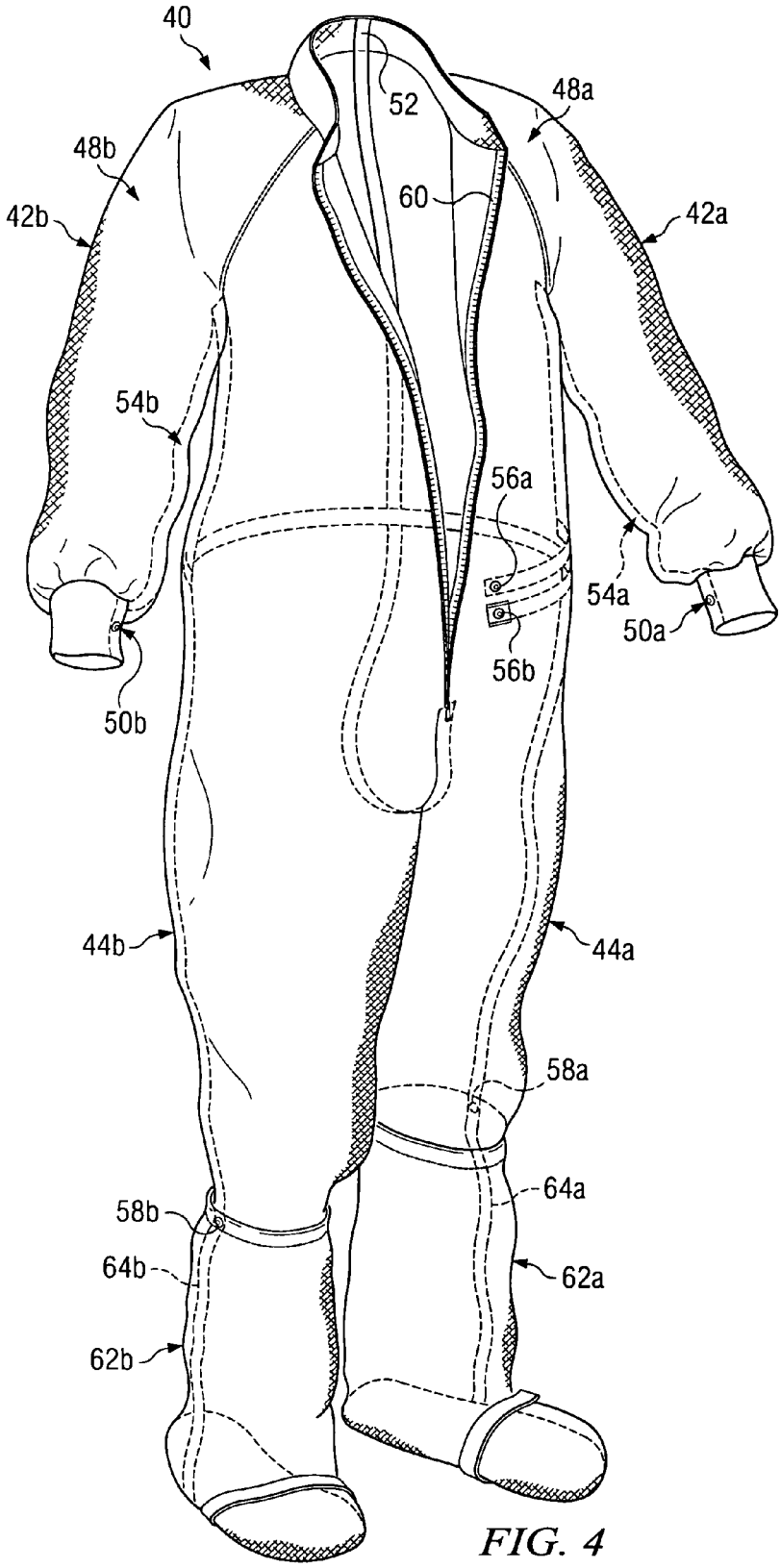
FIG. 4 shows a perspective view of the bunny suit of FIG. 3 including a coupled pair of booties.
Figure 5:
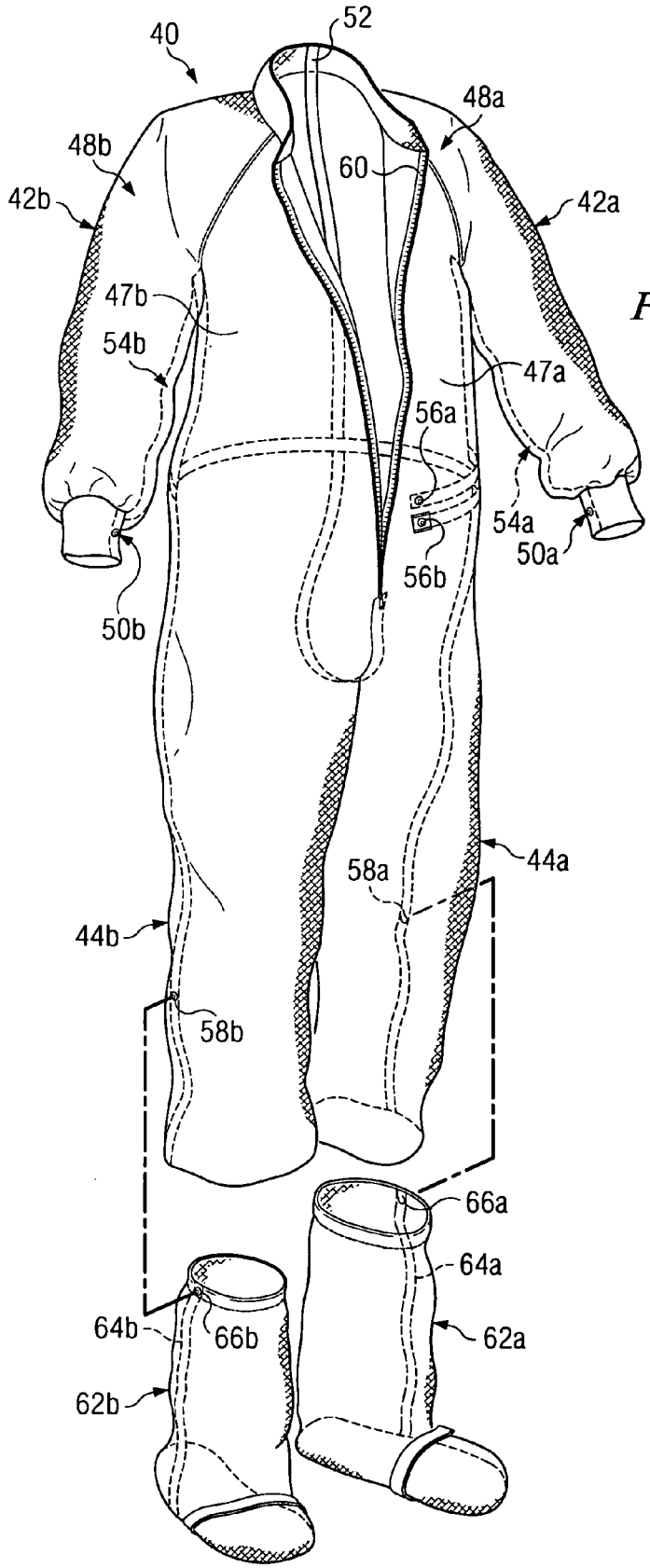
FIG. 5 shows a perspective view of the bunny suit and the booties of FIG. 4, in an uncoupled configuration.

Referring to FIGS. 4 and 5, the first conductive portion 48*a* may comprise a first bootie 62*a*, and the second conductive portion 48*b* may comprise a second bootie 62*b*. These booties 62*a*, 62*b* preferably shield the user's feet, and ensure that excess charge does not build up and discharge via the user's shoes. In one embodiment, the fabric comprising the top portions of the booties 62*a*, 62*b* is the same material comprising the rest of the first and second conductive portions 48*a*, 48*b*, and the booties 62*a*, 62*b* have rubber soles. Of course, other configurations for the booties are possible.

Referring to FIG. 4, the first and second booties 62*a*, 62*b* are illustrated as electrically coupled to the bunny suit 40. In one embodiment, the ribbon of conductive material 54*a* is coupled through a bootie interface 58*a* of the bunny suit 40 to a corresponding ribbon of conductive material 64*a* running through the bootie 62*a*. The other bootie 62*b* is configured similarly. Thus, the entire first conductive portion 48*a* may be understood to include the arm 42*a*, one side of the torso portion 46, the leg 44*a*, and the bootie 62*a*. In FIG. 5, the first and second booties 62*a*, 62*b* are illustrated in an uncoupled configuration, with the first and second bunny interfaces 66*a*, 66*b* visible. The first and second bunny interfaces 66*a*, 66*b* are preferably configured to correspond with and engage the first and second bootie interfaces 58*a*, 58*b* respectively to create an electrical connection.

Figure 6:
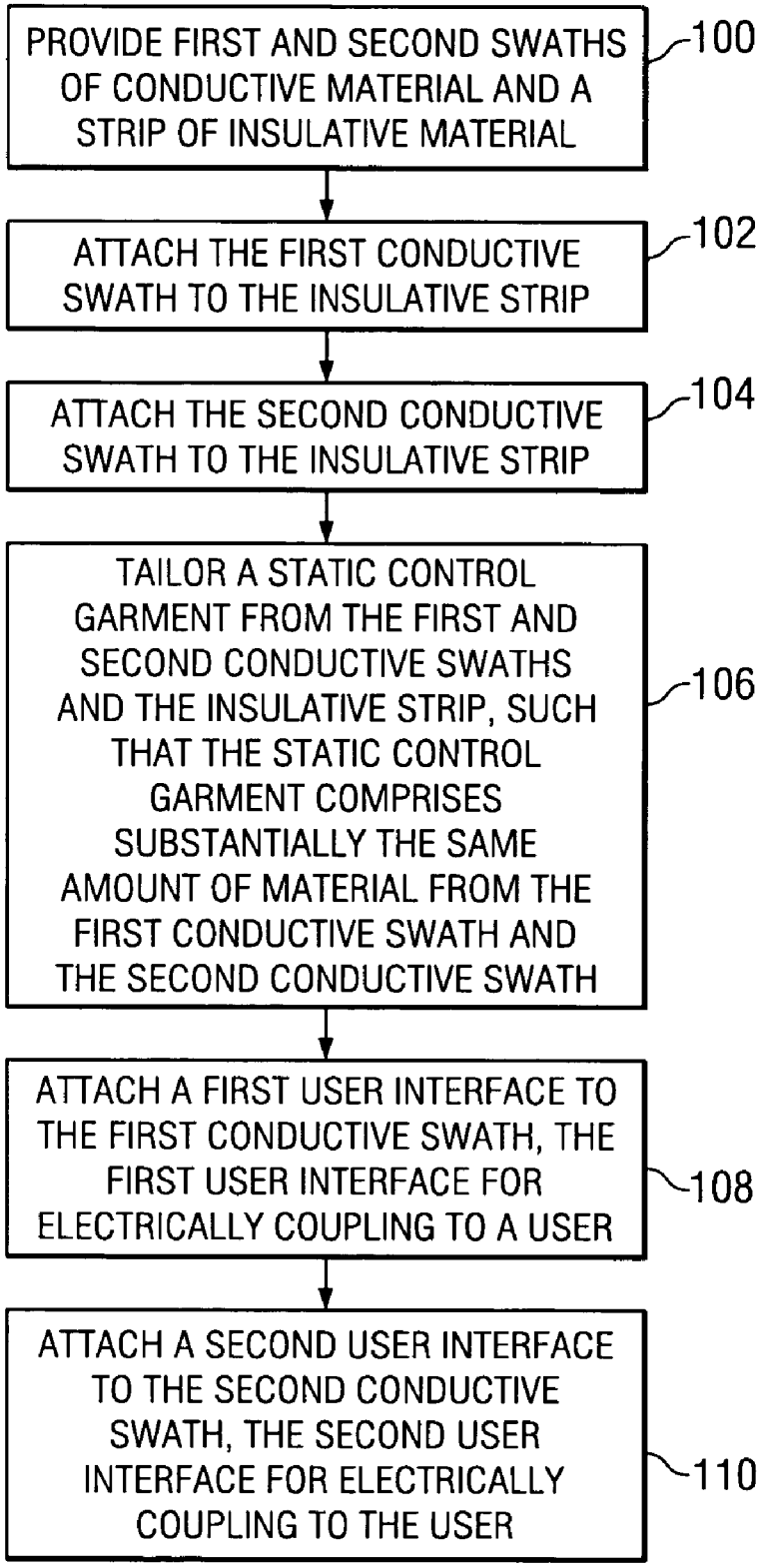
FIG. 6 illustrates the steps of one method of manufacturing a static control garment according to one embodiment of the present invention.

Referring to FIG. 6, a flow chart illustrating the steps of a method of manufacturing a static control garment according to one embodiment of the invention is set forth. As illustrated, the method may comprise: providing first and second swaths of conductive material and a strip of insulative material (step 100); attaching the first conductive swath to the insulative strip (step 102); attaching the second conductive swath to the insulative strip (step 104); tailoring a static control garment from the first and second conductive swaths and the insulative strip, such that the static control garment comprises substantially the same amount of material from the first conductive swath and the second conductive swath (step 106); attaching a first user interface to the first conductive swath, the first user interface for electrically coupling to a user (step 108); and attaching a second user interface to the second conductive swath, the second user interface for electrically coupling to the user (step 110).

As shown at step 100, first and second swaths of conductive material and a strip of insulative material are first provided. As discussed at length above, in one embodiment, the swaths of conductive material comprise polyester carbon-infused nylon, but may alternatively comprise any conductive fabric. The swaths of conductive material preferably include a continuous grid of conductive filaments. The strip of insulative material may also comprise any insulative fabric, and, in one preferred embodiment, comprises polyester.

The swaths of conductive material may be provided in many forms. In one embodiment, the fabric is sold in large rolls from which the swaths of conductive material may be cut. In one embodiment, the first and second swaths of conductive material comprise the same swath of conductive material until they are separated. The strip of insulative material may also be provided in many forms. It need not be uniform, and may vary greatly in dimension. In one embodiment, the strip of insulative material may be approximately 4 feet long and 1 inch wide.

At step 102, the first conductive swath is attached to the insulative strip. The means of attaching these two materials are well-known to those of skill in the art. In one embodiment, they are sewn together as is shown in FIG. 3A.

At step 104, the second conductive swath is attached to the insulative strip. Preferably, the two materials are attached identically to the method used in step 102, although variations are acceptable. The first and second conductive swaths are preferably attached to the same insulative strip, but are not attached directly to one another. In one embodiment, the first and second conductive swaths are attached to the insulative strip in order to insulate them from each other.

At step 106, the static control garment is tailored from the first and second conductive swaths and the insulative strip. Suitable tailoring processes are well-known in the art. In one embodiment, the swaths and strip are first cut, and then stitched together in order to create a garment that is wearable. For example, the swaths and insulative strip may be tailored to create a bunny suit 40 (such as that shown in FIG. 3) or a labcoat 10 (such as that shown in FIG. 1). In certain embodiments, the tailoring yields at least a torso portion for surrounding the user's torso, and two arm portions for covering the user's arms.

During this tailoring step, the static control garment may be tailored to comprise substantially the same amount of material from the first conductive swath and the second conductive swath. Of course, the amount of material used from each swath will not be exactly the same due at least to manufacturing tolerances. The static control garment may be understood to be tailored from substantially the same amount of material from the first and second conductive swaths if it satisfies at least one of the criteria set forth above in great detail. In one embodiment, the tailoring is performed such that the insulative strip runs down a user's torso, and, in one embodiment, down a mid-line of a user's body, thereby roughly ensuring that the material from each conductive swath will be approximately the same.

At step 108, a first user interface is attached to the first conductive swath, the first user interface for electrically coupling to the user. As discussed above, the first user interface may include a metal plate that may be pressed against a user's skin. In another embodiment, the second user interface may comprise a cuff, such as an elastic, stretchable cuff incorporated into the garment.

At step 110, a second user interface is attached to the second conductive swath, the second user interface for electrically coupling to the user. Preferably, the second user interface is generally constructed and attached in a manner similar to the first user interface discussed above.

What is claimed is:

1. A static control garment configured to be worn by a user, the garment comprising:

first and second conductive portions, wherein the first conductive portion comprises a first leg portion and the second conductive portion comprises a second leg portion;

a first user interface for electrically coupling the first conductive portion to the user;

a second user interface for electrically coupling the second conductive portion to the user; and an insulative portion coupled to, and electrically insulating the first conductive portion from the second conductive portion, wherein the insulative portion divides the static control garment such that the first and second conductive portions comprise substantially the same amount of conductive material.

2. The garment of claim 1, further comprising first and second electrical interfaces for electrically coupling to a monitoring device.

3. The garment of claim 2, wherein the first user interface is electrically coupled to the first electrical interface, and the second user interface is electrically coupled to the second electrical interface.

4. The garment of claim 2, wherein the second electrical interface is surrounded by the first conductive portion, and is insulated from the first conductive portion.

5. The garment of claim 2, wherein the first and second electrical interfaces are adjacent one another and are surrounded by the first conductive portion.

6. The garment of claim 1, wherein the first conductive portion comprises a first bootie, and the second conductive portion comprises a second bootie.

7. The garment of claim 1, wherein the capacitance between each of the first and second conductive portions and ground is approximately equal.

8. A static control garment configured to be worn by a user, the garment comprising:

first and second arm portions; and a torso portion, wherein the torso portion further comprises a first conductive portion comprising the first arm portion, a second conductive portion comprising the second arm portion, and an insulative portion electrically insulating the first conductive portion from the second conductive portion, wherein the insulative portion divides the static control garment such that the first and second conductive portions comprise substantially the same amount of conductive material.

9. The garment of claim 8, wherein the capacitance between each of the first and second conductive portions and ground is approximately equal.

10. The garment of claim 8, wherein the first conductive portion is electrically coupled to the first arm portion, and the second conductive portion is electrically coupled to the second arm portion.

11. The garment of claim 10, wherein the first arm portion comprises a first user interface, and the second arm portion comprises a second user interface.

12. The garment of claim 11, further comprising first and second electrical interfaces for electrically coupling to a monitoring device.

13. The garment of claim 12, wherein the first user interface is electrically coupled to the first electrical interface, and the second user interface is electrically coupled to the second electrical interface.

14. The garment of claim 12, wherein the second electrical interface is surrounded by the first conductive portion, and is insulated from the first conductive portion.

15. The garment of claim 12, wherein the first and second electrical interfaces are adjacent one another and are surrounded by the first conductive portion.

16. The garment of claim 8, further comprising first and second leg portions, wherein the first conductive portion is electrically coupled to the first leg portion, and the second conductive portion is electrically coupled to the second leg portion.

17. The garment of claim 16, further comprising a first bootie coupled to the first leg portion and a second bootie coupled to the second leg portion.

* * * * *